US005154282A

United States Patent [19]

Pascal

[11] Patent Number: 5,154,282

[45] Date of Patent: Oct. 13, 1992

[54] ELECTRICAL CONTACTOR FOR A PNEUMATIC BRAKE BOOSTER

[75] Inventor: Le Normand Pascal, Bois, France

[73] Assignee: Bendix Europe Services Techniques, Drancy, France

[21] Appl. No.: 726,716

[22] Filed: Jul. 1, 1991

Related U.S. Application Data

[63] Continuation of Ser. No. 546,651, Jul. 5, 1990, abandoned, which is a continuation of Ser. No. 357,116, May 25, 1989, abandoned.

[30] Foreign Application Priority Data

Jun. 27, 1988 [FR] France ..... 88 08584

[51] Int. Cl.[5] ..... H01H 13/70

[52] U.S. Cl. ..... 200/345; 200/43.18

[58] Field of Search ..... 200/345, 43.18, 43.19, 200/306

[56] References Cited

U.S. PATENT DOCUMENTS

| | | | |
|---|---|---|---|
| 1,101,866 | 6/1914 | McConnell | 200/43.18 |
| 3,251,971 | 5/1966 | Fraser | 200/223 |
| 3,821,529 | 6/1974 | Kallage, Jr. et al. | 200/345 |
| 4,497,987 | 2/1985 | Melys | 200/42 R |
| 4,629,842 | 12/1986 | Picot et al. | 200/342 |
| 4,689,454 | 8/1987 | Schulte et al. | 200/520 |

FOREIGN PATENT DOCUMENTS

| | | | |
|---|---|---|---|
| 0160586 | 11/1985 | European Pat. Off. . | |
| 7308411 | 3/1973 | Fed. Rep. of Germany . | |
| 2441258 | 6/1980 | France . | |
| 2532105 | 2/1984 | France . | |
| 1038758 | 8/1966 | United Kingdom . | |
| 2120853 | 12/1983 | United Kingdom | 200/306 |

*Primary Examiner*—Henry J. Recla
*Assistant Examiner*—David J. Walczak
*Attorney, Agent, or Firm*—Larry J. Palguta; Ken C. Decker

[57] ABSTRACT

The invention relates to an electrical contactor intended to be connected to an electrical brake warning circuit and to be mounted with sealing engagement in an orifice (5) in a rear wall (1) of a pneumatic brake booster housing divided into a front chamber (3) and a rear chamber (4) intercommunicating selectively via a piston mechanism (2) movable from a rest position near the rear wall (1), the contactor comprising a plastic body with a first body part (6) intended to be engaged into the orifice (5) in the rear wall (1) and a second body part (7) remaining outside the housing and containing at least one pair of metal electrical contacts (20, 21) actuable by way of a follower (13) equipped with a head (14) and slidably mounted in a bore (11) of the first body part (6) and stressed by a spring (19) toward the outside of the first body part, so that its head normally bears against the piston means (2) in the vicinity of its rest position, the pair of contacts comprising a stationary contact blade (20) and a movable contact blade (21) stressed elastically away from the stationary contact blade (20) in the opposite direction to the direction of stressing of the follower (13) and coupled to a plunger (15). According to the invention, the plunger (15) is connected to the follower (13) by a one-way elastic engagement mechanism (26, 30; 107, 110; 202, 210).

3 Claims, 4 Drawing Sheets

ELECTRICAL CONTACTOR FOR A PNEUMATIC BRAKE BOOSTER

Figure 1:
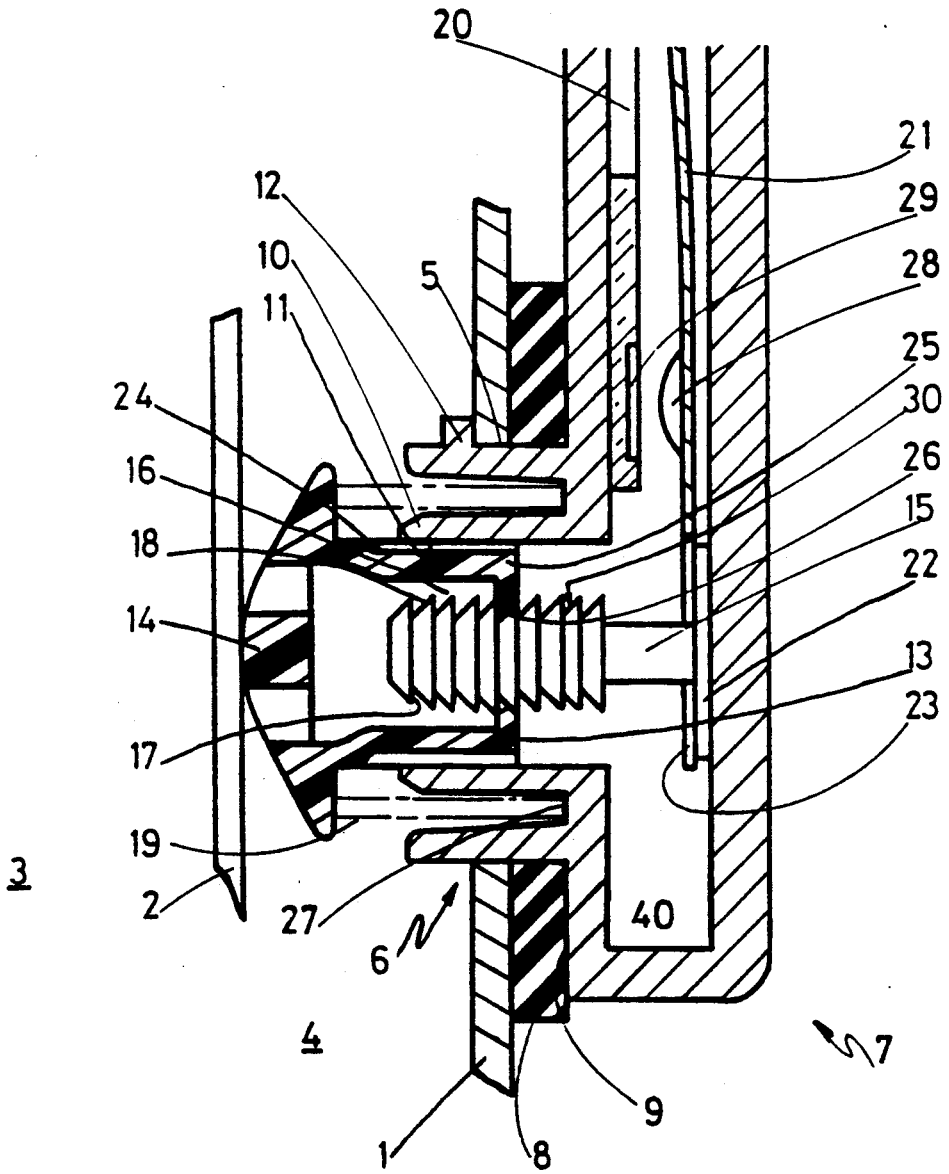

This is a continuation of abandoned application Ser. No. 07/546,651 filed Jul. 5, 1990 which is a continuation of abandoned application Ser. No. 07/357,116 filed on May 25, 1989.

The present invention relates to electric contactors for pneumatic brake boosters intended especially for equipping motor vehicles.

More specifically, the present invention relates to electrical contactors intended to be connected to an electrical brake warning circuit and to be mounted with sealing engagement in an orifice in a rear wall of a pneumatic booster housing divided into a front chamber and a rear chamber intercommunicating selectively via a piston means movable from a rest position near to the rear wall, the contactor being of the type comprising a plastic body with a first body part intended to be engaged into the orifice in the rear wall of the booster housing and a second body part remaining outside the booster housing and containing at least one pair of electrical metal contacts actuable by means of a follower slidably mounted in a bore of the first body part and stressed by a spring towards the outside of this first body part in order normally to bear against the piston means when the latter is in the vicinity of its rest position, the pair of contacts comprising a stationary contact blade and a movable contact blade stressed of elastically away from the stationary contact blade in the opposite direction to the direction of stressing of the follower and coupled to a plunger.

An electrical brake warning contactor of this type is described in document FR-A-2,561,817, and its corresponding U.S. Pat. No. 4,629,842 the content of which is assumed to be incorporated here for reference. In document, the follower is formed on the inside with a cylindrical central receptacle, in which slides a part of widened diameter of a plunger having an annular flange at its end adjacent to the head of the follower and another annular flange at its opposite end, the two flanges being connected to the part of widened diameter of the plunger by means of parts of reduced diameter. The follower also possesses an annular abutment projecting radially inwards into the receptacle and capable of interacting with the rear face of the flange or end collar of the plunger.

In the rest configuration, between the end collar of the plunger and the annular abutment of the follower there is a play which can vary considerably in proportion and thus accommodate the positioning tolerances at rest between the piston means and the rear wall of the booster housing, without thereby changing the rest position of the assembly composed of the movable contact blade and of the plunger. In contrast, during operation, when the piston is moved away from the rear wall under the effect of the intake of atmospheric air into the rear working chamber, the follower follows the movement of the piston means, first of all cancelling the idle stroke and then, by means of its inner annular abutment, taking the plunger with it until the contact stud of the movable blade comes up against the stationary contact blade counter to the elastic stress inherent in the movable contact blade.

Since the above-mentioned play can vary in considerable proportions, contact will therefore be made at different moments in the stroke of the piston means and consequently at different moments during braking. This therefore results in the disadvantage that the brake warning may only occur when braking has already become effective, whereas it is desirable that the brake warning should occur as soon as possible.

To overcome this disadvantage, an object of the present invention is to provide an electrical contactor of the above-mentioned type, the mounting of which makes it possible to take into account the positioning tolerances at rest between the piston and the rear wall of the booster housing and which makes the brake warning contact at the very start of the braking period.

To achieve this object, according to this invention the plunger is connected to the follower by a one-way elastic engagement means.

Thus, at the time of the mounting of the contactor according to the invention on the rear wall of the housing of the pneumatic brake booster, the plunger assumes relative to the follower a position which depends on the positioning tolerances at rest between the piston mean and the rear wall of the booster housing and "memorizes" this position once and for all. As a result, the brake warning contact is made as soon as the piston means has covered a distance equal to that separating the contact stud of the movable blade from the stationary contact blade, and this distance can be made as short as desired and does not depend on the production tolerances of the booster.

Figure 2:
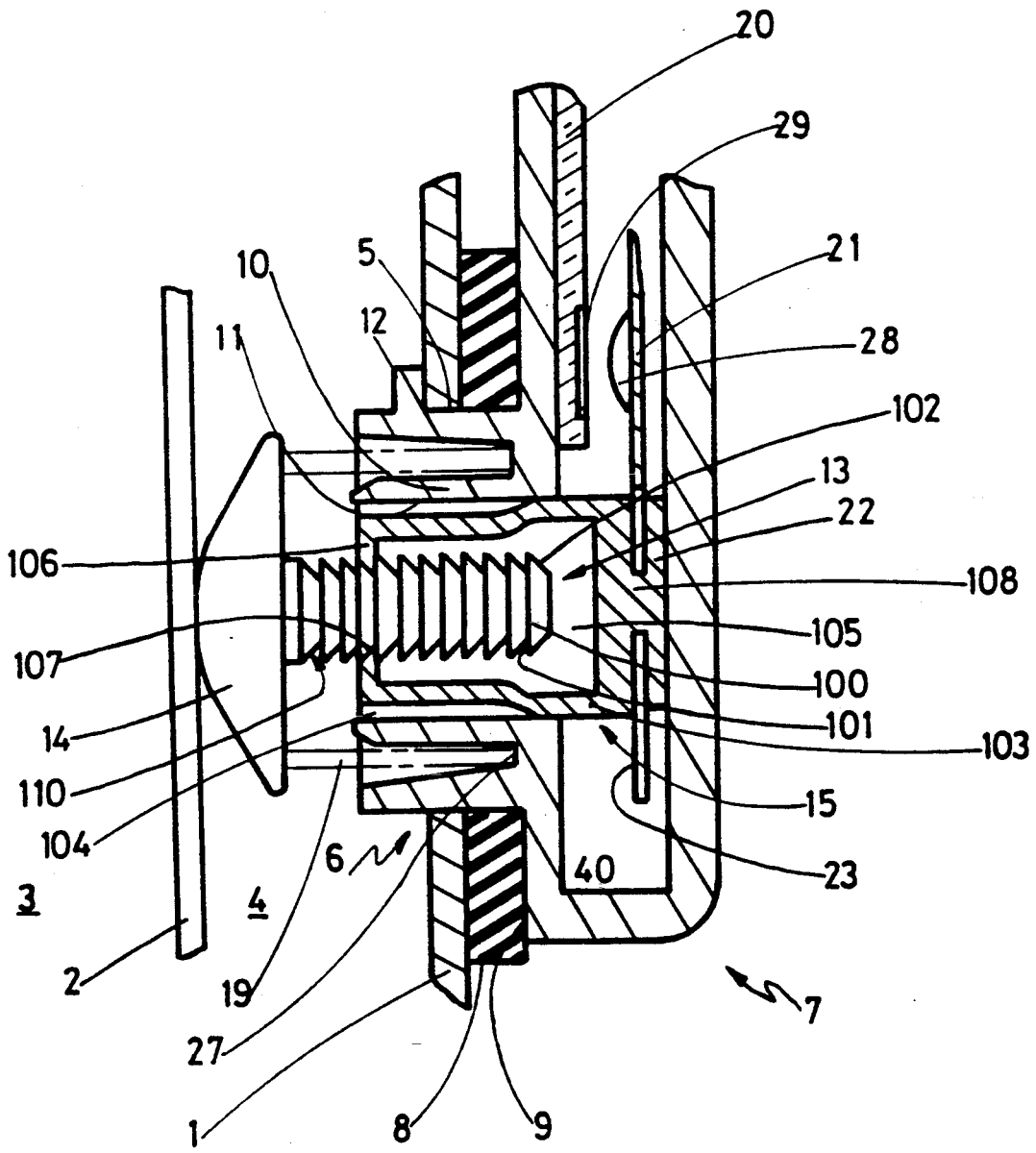
Figure 3:
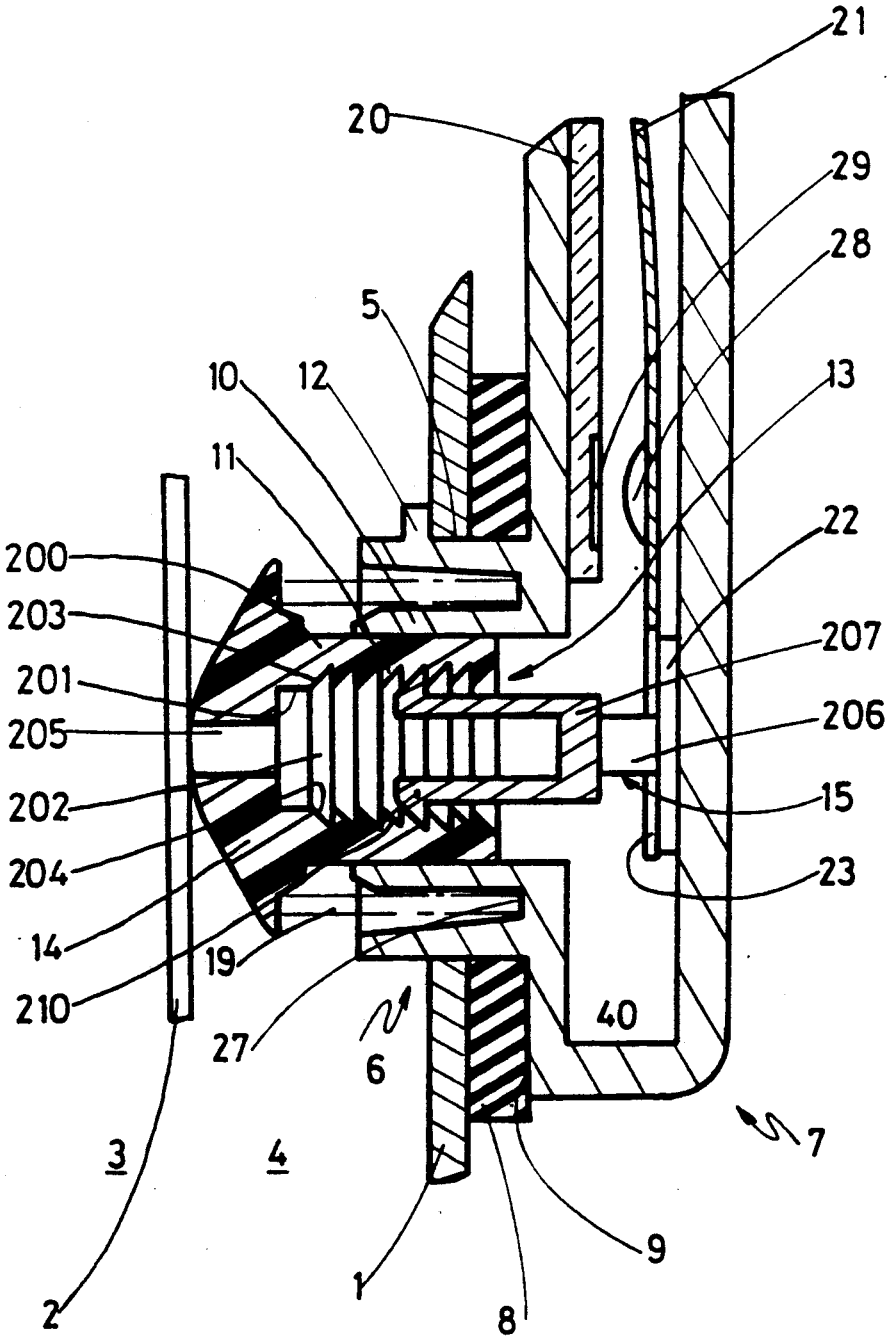
Figure 4:
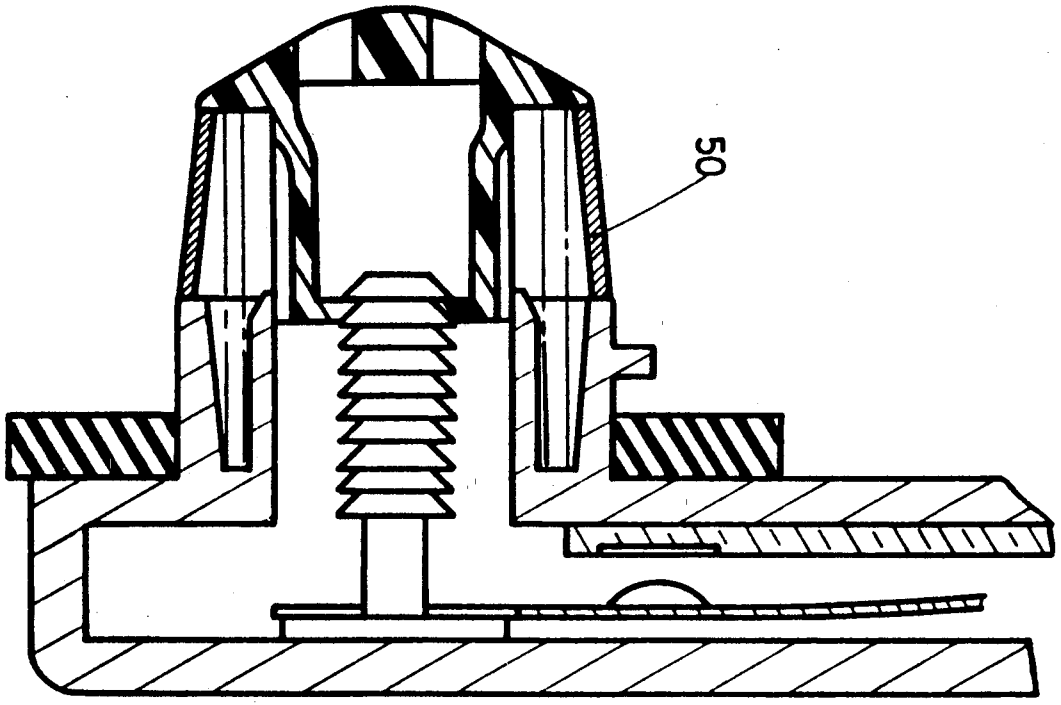

The invention will now be described by way of example with reference to the accompanying drawings in which:

FIG. 1 shows a view in longitudinal section of a first embodiment of an electrical contactor according to the invention mounted in place on the rear wall of a pneumatic brake booster housing, FIG. 2 is a view, similar to that of FIG. 1, of a second embodiment of the invention, FIG. 3 is a view, similar to the two preceding ones, of a third embodiment of the invention, and FIG. 4 is a sectional view of a contactor ready to be installed.

In the Figures, the identical elements bear the same reference numerals.

FIG. 1 shows a portion of the rear wall 1 of a pneumatic brake booster housing divided internally by a piston means 2 into a front chamber, or vacuum chamber 3, and a rear chamber, or working chamber 4, between the piston means 2 and the rear wall 1. This rear wall 1 has an orifice 5, in which is mounted by one-way elastic engagement a first body part 6 of an electrical contactor which also possesses a second body part 7 remaining outside the rear wall 1 of the booster housing, the two body parts 6 and 7 being formed in one piece from a plastic having some elasticity, in order to allow the first body part 6 to engage elastically into the orifice 5 and be kept locked in place in the latter. The first body part 6 has a general cylindrical shape and is equipped peripherally with an annular seal 8 intended, in the mounted configuration, to be compressed between the rear outer face of the rear wall 1 and an annular shoulder 9, defined round the first body part 6, by the front face of the second body part 7.

The contactor can be mounted on the rear wall 1 by any known method. Advantageously, the so-called "bayonet" mounting can be used, the first body part 6 for this purpose having radial protuberances 12, only one of which is shown.

The first body part 6 has a central part 10 formed with a central bore 11, in which is mounted slidably a follower 13 carrying an end head 14 intended to come to bear against the rear face of the piston means 2 of the booster. The cylindrical part of the follower 13 is equipped with axial grooves 24 on its periphery, allowing the working chamber 4 to communicate with the interior of a cavity 40 located at the rear of the follower 13. Communication of the working chamber with the rear cavity is described in the document FR-A-2,561,817.

According to the invention, the follower 13 is formed internally with a cylindrical central receptacle 16 delimited, at the end opposite that carrying the head 14, by a wall 25 having an orifice 26 of the general form of a circle, the diameter of which varies linearly between the two edges of the wall 25, in such a way that the orifice 26 defines in the wall 25 a volume of general frustoconical form, the small base of which is on the same side as the head 14.

According to the invention, there is a plunger 15, the head of which enters the receptacle 16 via the orifice 26.

The head of the plunger 15 has the general form of a cylinder and, on its periphery, possesses contiguous circular flutes 30 formed in a plane perpendicular to the axis of the plunger. Each flute has, in cross-section, the form of a "V", one side 17 of which is perpendicular to the axis of the cylinder forming the head of the plunger 15, the other side of each flute being inclined relative to this axis, the inclined side of the flute being located on the same side as the head 14 of the follower 13. The head of the plunger 15 could also be defined as consisting of a stack of identical truncated cones stacked coaxially in the same direction, the small base of one being merged with the large base of the next. Advantageously, the thickness of each elementary truncated cone is equal to that of the wall 25 at the end of the follower 13, and the angle at the apex of the cone is equal to that formed in the orifice 26 in the wall 25 of the follower 13, so that the orifice 26 and the flutes 30 have matching forms capable of interacting to effect a one-way elastic engagement of parts in relief formed on one of the components with recessed parts formed on the other component.

The follower 13 is stressed towards the outside of the first body part 6 in the direction towards the piston means 2 by a helical spring 19 mounted on the periphery of the central part 10 and bearing, on the one hand, on the bottom of an annular slot 27 formed in the part 10 and of the same axis as the bore 11 and, on the other hand, on the rear face of the head 14 of the follower 13.

As described in the above-mentioned document, mounted in the elongate cavity 40 of the second body part 7 of the contactor perpendicularly relative to the plunger 15 are a stationary contact blade 20 positioned on the front face of the cavity 40 adjacent to the rear wall 1 of the booster housing and a movable contact blade 21 made of elastic metal and shaped so as to extend, at rest, at an angle relative to the stationary contact blade 20 away from the latter. Typically, the movable contact blade 21 is mounted cantilevered by means of its end (not shown) distant from the plunger 15, and its free end 23 is cut in the form of a U and engaged onto a part of reduced diameter between the head of the plunger 15 and the foot 22 of the plunger 15, in order normally to stress the latter up against the rear face of the cavity 40 under the effect of the inherent elasticity of the movable contact blade 21.

As described in the above-mentioned document, the movable contact blade 21 is advantageously crimped at its end distant from the plunger 15 in a cover (not shown) mounted and welded, for example ultrasonically, in a widened end of the cavity 40 opposite the first body part 6, so as to close this cavity 40 sealingly, the cover having electrical members for connecting the contact blades 20 and 21 to an electrical brake warning circuit (not shown). Preferably, the movable contact blade 21 is equipped with a hemispherical contact-making zone 28 intended for interacting with a recessed contact zone 29 of the stationary contact 20.

The contactor according to the present invention is mounted in the following way. The central part 10 of the first body part 6 is first equipped with the sealing means 8, the spring 19 is subsequently introduced into the slot 27, and then the follower 13 is inserted into the bore 11 in such a way that the orifice 26 in the wall 25 interacts with one of the first flutes formed on the head of the plunger 15.

Before the follower 13 is introduced into the bore 11, it is possible advantageously to provide a collar or sleeve 50 (FIG. 4) which bears on the end of the outer part of the first body part 6 and against which the rear face of the head 14 will butt. This sleeve performs the triple function of making it possible for the follower to engage only on one of the first flutes of the plunger, of protecting the spring 19 during transport and of preventing any accidental excessive pushing of the follower onto the plunger, thereby rendering the contactor useless. It will be possible to tear this sleeve off easily at the time when the contactor is installed on the rear wall of the booster, by any known method (lines of less resistance, initial tearing point, and the like).

When the assembly has been prepared in this way and as it is shown in FIG. 4, after the sleeve 50 has been torn off, the first body part 6 is introduced into the orifice 5 in the rear wall 1 of the booster housing, in such a way that the radial protuberances 12 come opposite radial indentations of corresponding forms and dimensions made in the periphery of the orifice 5. During this introduction, the head 14 of the follower 13 is made to meet the piston means 2. As a result of the relative elasticity of the wall 25 of the follower 13 and the resistance opposed by the piston means 2, the plunger 15 enters the orifice 26 until the protuberances 12 have passed the corresponding indentations. The sealing means 8 is then compressed, and a rotation of the contactor as a whole brings the protuberances 12 behind the wall 1, thus locking the contactor in the operating position.

It will therefore be seen that the orifice 26 in the wall 25 of the follower 13 interacts with the head of the plunger 15 in the manner of a one-way elastic engagement which, during the mounting of the contactor on the rear wall of the booster housing, makes it possible to adjust the length of the follower/plunger assembly in order to take into account the positioning tolerances at rest between the piston means 2 and the rear wall 1 of the booster housing.

During operation, when the piston means 2 is moved away from the rear wall 1 under the effect of the intake of atmospheric air into the rear working chamber, the follower 13 follows the movement of the piston means 2 under the effect of the spring 19, taking with it the orifice 26 interacting with the flutes formed on the head of the plunger 15, until the contact stud 28 of the movable blade 21 is laid against the stationary contact blade 20 counter to the elastic stress inherent in the movable contact blade 21. The one-way elastic engagement between the plunger and the follower prevents any relative movement between these two components, the follower being stressed towards the outside of the first body part 6 by the spring 19, while the plunger is stressed in the other direction as a result of the elastic force inherent in the movable contact blade 21, the rigidity of which is equal to approximately half that of the spring 19.

It will thus be seen that, by means of the invention, the brake warning contact is always obtained after a stroke of the piston means 2 corresponding to the distance between the contact stud 28 of the movable blade 21 and the stationary contact blade 20, this stroke typically being a few millimetres. The contact is therefore made at the very start of the braking period, whatever the production or assembly tolerances, and without any adjustment.

FIGS. 2 and 3 illustrate two other embodiments of contactors according to the invention, the connection between the follower and the plunger being made with one-way elastic engagement.

In FIG. 2, the follower 13 is formed from a head 14 coming to bear on the rear face of the piston means 2 of the booster and from a foot 100 having the general form of a cylinder. The foot 100 has, on its periphery, contigous circular flutes 110, each flute having, in cross-section, the form of a "V", of which one side 101 is perpendicular to the axis of the cylinder forming the foot and the other side 102 is inclined relative to this axis, the inclined side of the flute being located on the same side as the head 14 of the follower 13. The foot of the feeler 13 could also be defined as consisting of a stack of identical truncated cones stacked coaxially in the same direction, the small base of one being merged with the large base of the next.

The plunger 15 is formed from a cylindrical part 103 sliding in the bore 11 and equipped with axial grooves 104 on its periphery, allowing the working chamber 4 to communicate with the interior of the cavity 40. The plunger 15 is formed internally with a cylindrical central receptacle 105 delimited, at its end directed towards the head 14 of the follower, by a wall 106 having an orifice 107 of the general for of a circle, the diameter of which varies linearly between the two edges of the wall 106, in such a way that the orifice 107 defines in the wall 106 a volume of general frustoconical form, the large base of which is on the same side as the head 14 of the follower 13. The other end of the plunger 15 is connected by means of a part 108 to a foot 22 interacting with the movable contact blade 21.

The other elements of the contactor of FIG. 2 are identical to those of FIG. 1, and its mode of operation is identical, only the plunger and the follower having been modified, but still performing the same function of connection with one-way elastic engagement.

Likewise, FIG. 3 shows a third embodiment of the plunger and of the follower performing the function of connection with one-way elastic engagement, in a contactor of which the other elements and the mode of operation are identical to those of the two preceding embodiments.

According to the embodiment of FIG. 3, the follower 13 comprises a cylindrical body 200 sliding in the bore 11 in the first part of the body 6, carrying a head 14 at one end and equipped with a bore 201 at its other end. Contiguous circular flutes 202 are marked internally in the bore 201, each flute having, in cross-section, the form of a "V", of which one side 203 is perpendicular to the axis of the bore 201 and the other side 204 is inclined relative to this axis, the inclined side of the flute being located on the same side as the head 14 of the follower 13. A hole 205 is also made in the head 14 so as to put the spaces located in front of and behind the follower 13 in communication with one another.

The plunger 15 is formed from a foot 22 interacting with the blade 21, this foot 22 being connected by means of a part 206 to a lyre-shaped part 207, the branches of which carry at their ends protuberances or hooks 210 of "V"-shaped cross-section which are capable of engaging into the inner flutes of the follower.

The other elements of the contactor of FIG. 3 and its mode of operation are identical to those of the other two embodiments.

Three embodiments of the invention thus having been described, it is clear that many modifications can be made to it by a person skilled in the art, without thereby departing from its scope. Thus, any type of one-way elastic engagement between the follower and the plunger can be used, such as, for example, a one-way ball-type or spring-type linear clutch. Likewise, the engagement between the plunger and the follower can be obtained over several flutes, and/or the parts on which this engagement is effected can have a form other than cylindrical or circular, for example square or rectangular.

Finally, it is very clear that the electrical contactor of the invention, although having been described more particularly with regard to electrical brake warning circuits, can also serve for closing a circuit when the piston means has executed a predetermined stroke, the length of this stroke being equal to the distance between the contact stud of the movable blade and the stationary contact blade.

I claim:

1. A method of assembling an electrical contactor with a pneumatic brake booster, the brake booster comprising a housing divided into a front chamber and a rear chamber intercommunicating selectively via piston means movable from a rest position near a rear wall of the pneumatic brake booster, the contactor comprising a plastic body with a first body part and a second body part which defines a cavity containing at least one pair of metal electrical contacts actuatable by means of a follower equipped with a head and the follower mounted slidably in a bore in the first body part and stressed by a spring outwardly of the first body part, the pair of contacts comprising a stationary contact blade and a movable contact blade stressed elastically away from the stationary contact blade in a direction opposite to the direction of stressing of the follower and coupled to a plunger, said plunger being connected to the follower by one-way elastic engagement means as a result of parts in relief formed on one of the plunger or follower with recessed parts formed on the other one of the follower or plunger, said recessed parts being circular flutes in a plane perpendicular to an axis of symmetry of one of the plunger and follower on which the flutes are formed, said plunger and follower interacting with each other by means of only one flute, said spring bearing on said first body part and a head of said follower, the follower being equipped with at least one axial groove at the periphery thereof and a hole in the head, the assembly being achieved by the steps of:

a. introducing said first body part of the contactor into an orifice in the rear wall of the pneumatic brake booster, the first body part including radial protuberances which pass through corresponding radial indentations of said orifice, b. engaging the follower with the piston means such that the plunger advances toward and contacts the follower which effects an adjusting of the overall length of the follower and plunger and thereby compensating for positioning tolerances existing between the piston means at rest and the rear wall of the pneumatic brake booster, and c. rotating the second body part which is outside of the housing, after the protuberances pass through the indentations; in order to lock the contactor in an operating position to the housing.

2. The method according to claim 1, further comprising the steps of locating removable means between an end of an outer part of the first body part and the head of the follower, the removable means engaging a rear face of the head of the follower, and removing the removable means prior to said assembly.

3. The method according to claim 1, further comprising the step of locating sealing means about a portion of the first body part such that the sealing means remains compressed between the second body part and housing after said rotation of the second body part.

* * * * *